US007518476B2

(12) United States Patent
Spitsberg et al.

(10) Patent No.: US 7,518,476 B2
(45) **Date of Patent: *Apr. 14, 2009**

(54) ELECTRICAL SWITCHING APPARATUS AND TRIP ACTUATOR RESET ASSEMBLY THEREFOR

(75) Inventors: Yuri C. Spitsberg, Export, PA (US); Nathan J. Weister, Darlington, PA (US)

(73) Assignee: Eaton Corporation, Cleveland, OH (US)

( * ) Notice: Subject to any disclaimer, the term of this patent is extended or adjusted under 35 U.S.C. 154(b) by 105 days.

This patent is subject to a terminal disclaimer.

(21) Appl. No.: 11/696,812

(22) Filed: Apr. 5, 2007

(65) Prior Publication Data

US 2008/0245649 A1 Oct. 9, 2008

(51) Int. Cl.
*H01H 9/20* (2006.01)
*H01H 9/00* (2006.01)

(52) U.S. Cl. ..... 335/167; 335/172

(58) Field of Classification Search ..... 335/167–176
See application file for complete search history.

(56) References Cited

U.S. PATENT DOCUMENTS 3,360,751 A * 12/1967 Gauthier et al. ..... 335/175
4,000,478 A * 12/1976 Jencks et al. ..... 335/34
4,064,469 A * 12/1977 Gryctko ..... 335/6
4,097,831 A * 6/1978 Jencks et al. ..... 335/166
4,679,019 A * 7/1987 Todaro et al. ..... 335/172
5,294,903 A * 3/1994 Bosch et al. ..... 335/172
5,777,536 A * 7/1998 Lee et al. ..... 335/172
6,034,586 A * 3/2000 Runyan et al. ..... 335/172
6,150,909 A * 11/2000 Meier ..... 335/132
6,172,584 B1 * 1/2001 Castonguay et al. ..... 335/172
6,218,920 B1 * 4/2001 Reichard et al. ..... 335/176
6,307,455 B1 * 10/2001 Dolo et al. ..... 335/172
6,346,868 B1 * 2/2002 Castonguay et al. ..... 335/172
6,420,948 B1 * 7/2002 Runyan ..... 335/6
6,891,453 B2 * 5/2005 Castonguay et al. ..... 335/8
6,921,873 B2 7/2005 Puskar et al.
2002/0130744 A1 * 9/2002 Jodehl et al. ..... 335/172
2003/0112104 A1 * 6/2003 Douville et al. ..... 335/172
2003/0197581 A1 * 10/2003 O'Keeffe et al. ..... 335/172
2004/0227601 A1 * 11/2004 Brignoni et al. ..... 335/172
2006/0164195 A1 * 7/2006 Chung et al. ..... 335/172

* cited by examiner

*Primary Examiner*—Elvin G Enad
*Assistant Examiner*—Alexander Talpalatskiy
(74) *Attorney, Agent, or Firm*—Charles E. Kosinski

(57) ABSTRACT

A trip actuator reset assembly for a circuit breaker includes a cradle assembly, a reset lever, a trip actuator, and a resilient element. The cradle assembly is pivotably coupled to the circuit breaker pole shaft. The reset lever includes first and second ends, and a pivot pivotably coupling the reset lever to the circuit breaker housing. The resilient element is pivotably coupled to the housing proximate the second end of the reset lever. In response to a trip condition, an actuating element of the trip actuator moves the first end of the reset lever. To reset the trip actuator, a guide member guides the cradle assembly into engagement with the resilient element which pivots the reset lever. The first end of the reset lever then resets the trip actuator. After reset, if the cradle assembly continues to move, then the resilient element bends to accommodate the additional motion.

21 Claims, 6 Drawing Sheets

ELECTRICAL SWITCHING APPARATUS AND TRIP ACTUATOR RESET ASSEMBLY THEREFOR

CROSS REFERENCE TO RELATED APPLICATIONS

This application is related to commonly assigned, concurrently filed:

U.S. patent application Ser. No. 11/696,810, filed Apr. 5, 2007, entitled "ELECTRICAL SWITCHING APPARATUS AND TRIP ACTUATOR ASSEMBLY THEREFOR"; and U.S. patent application Ser. No. 11/696,815, filed Apr. 5, 2007, entitled "ELECTRICAL SWITCHING APPARATUS, AND TRIP ACTUATOR ASSEMBLY AND RESET ASSEMBLY THEREFOR", which are hereby incorporated herein by reference.

BACKGROUND OF THE INVENTION

1. Field of the Invention

The invention relates generally to electrical switching apparatus and, more particularly, to trip actuator assemblies for electrical switching apparatus, such as circuit breakers. The invention also relates to reset assemblies for circuit breaker trip actuator assemblies.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip unit.

Among other components, the operating mechanisms of some low-voltage circuit breakers, for example, typically include a pole shaft and a trip actuator assembly. The pole shaft pivots during opening and closing operations of the circuit breaker, which operations respectively correspond to electrical contact assemblies being opened (e.g., contacts separated) and closed (e.g., contacts electrically connected). The trip actuator assembly typically includes a trip bar, a trip actuator such as, for example, a solenoid, and a cradle assembly. The cradle assembly is coupled to and is cooperable with the pole shaft. The trip actuator (e.g., solenoid) has a spring, a coil which is energized by the trip unit in response to the electrical fault condition, and an actuating element such as, for example, a plunger. Normally (e.g., in the absence of the electrical fault condition), the plunger is latched (e.g., by a magnet) in a retracted position. When the coil is energized, in response to the electrical fault condition, the magnetic force that holds the plunger in the retracted position is overcome and the spring biases the plunger to an extended position and maintains it there. When the plunger extends, it causes the trip bar to pivot and trip open the electrical contact assemblies.

Subsequently, both the electrical contact assemblies and the trip actuator must be reset. The trip actuator assembly operates in conjunction with the pole shaft to perform the resetting operation. Specifically, when the circuit breaker operating mechanism is reset, the pole shaft pivots, thereby moving the cradle assembly. The cradle assembly then pivots a reset arm which, in turn, depresses the actuating element (e.g., plunger) and resets the trip actuator (e.g., solenoid).

The travel and actuating force of the plunger are relatively limited. Therefore, to ensure that the trip actuator assembly consistently performs properly, the trip actuator assembly must be well designed, and the trip actuator of this assembly must be accurately installed and maintained in a precise predetermined position within the circuit breaker.

In the above regard, known trip actuator assemblies suffer from a number of disadvantages. Among them is the fact that at least one component of the trip actuator assembly and, in particular, the trip actuator, is typically fastened to a portion of the circuit breaker that has no correlation to the tripping and/or resetting function(s) of the circuit breaker. This, alone or in combination with the fact that the trip actuator is typically fastened to such portion using hardware (e.g., brackets) and a plurality of fasteners, can result in misalignment of the trip actuator. In other words, misalignment of the trip actuator can result not only from the positioning of the hardware and trip actuator during its installation, but also from the fact that each component of the circuit breaker tends to vary in precise dimension due, for example, to manufacturing tolerances. When the circuit breaker is assembled, the tolerance variations from one part of the circuit breaker to the next can undesirably accumulate or "stack" up. Consequently, the accuracy with which the trip actuator is installed can be compromised, adversely affecting circuit breaker performance.

The aforementioned misalignment between circuit breaker components can also adversely affect the reset operation of the trip actuator assembly of known circuit breakers. For example, because the pole shaft, the cradle assembly, and the reset lever are coupled together, dimensional variations and/or assembly errors can result in imprecise interaction among these components. By way of example, the pole shaft and the cradle assembly may, for example, move in a manner which tends to over-rotate the reset lever of the trip actuator reset assembly. More specifically, over-rotation occurs when the reset lever has completely depressed the plunger, thus resetting the trip actuator, but the pole shaft and/or the cradle assembly continue to move causing the reset lever to continue to apply pressure to the plunger. It is desirable, therefore, to provide a trip actuator reset assembly that is capable of accommodating such over-rotation.

There is, therefore, room for improvement in electrical switching apparatus, such as circuit breakers, and in trip actuator reset assemblies therefor.

SUMMARY OF THE INVENTION

These needs and others are met by embodiments of the invention, which are directed to a trip actuator reset assembly for the trip actuator of electrical switching apparatus such as, for example, circuit breakers, which trip actuator reset assembly can accommodate dimensional and/or assembly imperfections and conditions (e.g., over-rotation of the pole shaft, cradle assembly and/or reset lever) caused thereby, in order to avoid damage to the circuit breaker and to accurately and consistently reset the trip actuator.

As one aspect of the invention, a trip actuator reset assembly is provided for an electrical switching apparatus including a housing, separable contacts enclosed by the housing, and an operating mechanism structured to open and close the separable contacts. The operating mechanism includes a pole shaft. The trip actuator reset assembly comprises: a cradle assembly including a first end structured to be pivotably coupled to the pole shaft, and a second end disposed opposite and distal from the first end, the cradle assembly being structured to be movable among a first position corresponding to the separable contacts being closed, and a second position corresponding to the separable contacts being open; a reset lever including a first end, a second end disposed opposite and distal from the first end of the reset lever, and a pivot structured to pivotably couple the reset lever to the housing; a trip actuator including an actuating element which, in response to a trip condition, is structured to move the first end of the reset lever; a resilient element structured to be pivotably coupled to the housing proximate the second end of the reset lever; and a guide member. After the trip condition, the actuating element of the trip actuator is structured to be reset. When the cradle assembly moves from the first position toward the second position, the guide member guides the cradle assembly into engagement with the resilient element which pivots the reset lever. When the resilient element pivots the reset lever, the first end of the reset lever moves the actuating element of the trip actuator, thereby resetting the trip actuator. After the trip actuator has been reset, if the cradle assembly continues to move beyond the second position, then the resilient element bends to accommodate any additional motion of the cradle assembly.

The housing of the electrical switching apparatus may include a mounting surface, a first side plate extending outwardly from the mounting surface, and a second side plate extending outwardly from the mounting surface. The guide member may include a first end, a second end disposed opposite and distal from the first end, and an elongated body extending between the first and second ends. The elongated body may be structured to extend between the first side plate and the second side plate. The cradle assembly may comprise a first side structured to extend from the pole shaft toward the second end of the cradle assembly, a second side disposed opposite and spaced from the first side of the cradle assembly, a first cross member disposed proximate the first end of the cradle assembly, a second cross member disposed at or about the second end of the cradle assembly, and at least one elongated member fixedly coupled to the second cross member and extending through the first cross member. The first cross member may extend between the first side of the cradle assembly and the second side of the cradle assembly. The first cross member may not move independently with respect to the first side of the cradle assembly and the second side of the cradle assembly. The second cross member may be structured to extend between and be pivotably coupled to the first side plate and the second side plate, thereby providing a fixed pivot point for the cradle assembly with respect to the first side plate and the second side plate.

The resilient element may be a leaf spring having a first end pivotably coupled to the second side of the first side plate, a second end disposed opposite and distal from the first end, and an intermediate portion extending between the first end and the second end. When the cradle assembly is moved toward the second position, the intermediate portion of the resilient element may engage the second end of the reset lever, thereby pivoting the reset lever. As the cradle assembly moves into the second position, the reset lever may be structured to continue to pivot until the first end of the reset lever completely depresses the plunger, thereby resetting the trip actuator and the trip lever. After the trip actuator is reset, if the cradle assembly continues to move, then the intermediate portion of the resilient element may bend to absorb such movement.

As another aspect of the invention, an electrical switching apparatus comprises: a housing; separable contacts enclosed by the housing; an operating mechanism structured to open and close the separable contacts, the operating mechanism including a pole shaft; and a trip actuator reset assembly comprising: a cradle assembly including a first end pivotably coupled to the pole shaft, and a second end disposed opposite and distal from the first end, the cradle assembly being movable among a first position corresponding to the separable contacts being closed, and a second position corresponding to the separable contacts being open, a reset lever including a first end, a second end disposed opposite and distal from the first end of the reset lever, and a pivot pivotably couple the reset lever to the housing, a trip actuator including an actuating element which, in response to an trip condition, moves the first end of the reset lever, a resilient element pivotably coupled to the housing proximate the second end of the reset lever, and a guide member. After the trip condition, the actuating element of the trip actuator must be reset. When the cradle assembly moves from the first position toward the second position, the guide member guides the cradle assembly into engagement with the resilient element which pivots the reset lever. When the resilient element pivots the reset lever, the first end of the reset lever moves the actuating element of the trip actuator, thereby resetting the trip actuator. After the trip actuator has been reset, if the cradle assembly continues to move beyond the second position, then the resilient element bends to accommodate any additional motion of the cradle assembly.

The electrical switching apparatus may be a circuit breaker. The operating mechanism of the circuit breaker further may comprise a trip bar and a trip lever extending outwardly from the trip bar, wherein the trip lever includes a first end which overlays the actuating element of the trip actuator, and a second end of the trip lever being coupled to the trip bar. The first end of the trip lever may be cooperable with the first end of the reset lever of the trip actuator reset assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
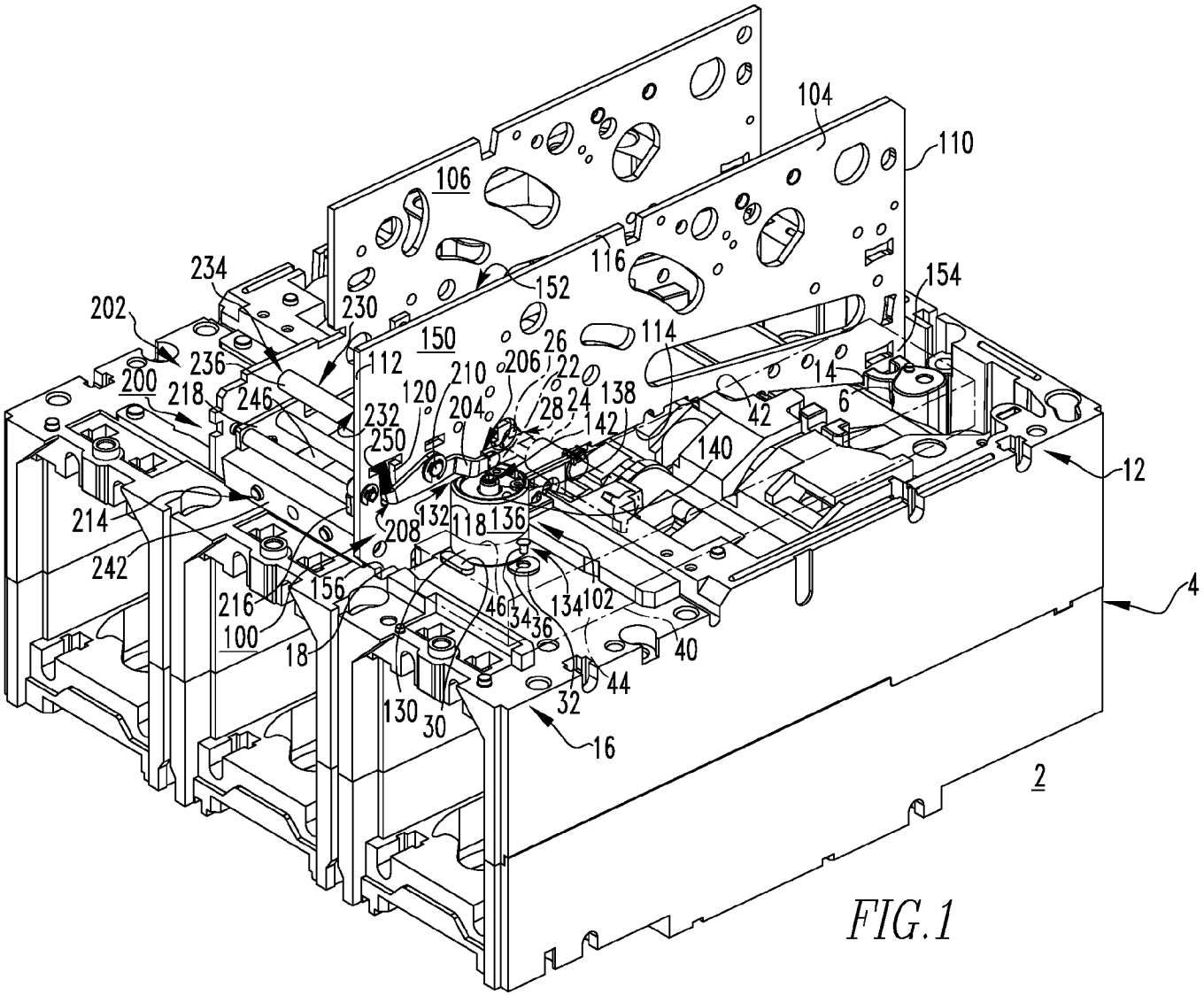
FIG. 1 is an isometric view of a circuit breaker and trip actuator assembly therefor, in accordance with an embodiment of the invention, also showing an accessory tray for the circuit breaker in simplified form in phantom line drawing.

For purposes of illustration, embodiments of the invention will be described as applied to low-voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage circuit breakers and other than low-voltage electrical switching apparatus.

Directional phrases used herein, such as, for example, left, right, top, bottom, upper, lower, front, back, clockwise and counterclockwise and derivatives thereof, relate to the orientation of the elements shown in the drawings and are not limiting upon the claims unless expressly recited therein.

As employed herein, the terms "actuator" and "actuating element" refer to any known or suitable output mechanism (e.g., without limitation, trip actuator; solenoid) for an electrical switching apparatus (e.g., without limitation, circuit switching devices, circuit breakers and other circuit interrupters, such as contactors, motor starters, motor controllers and other load controllers) and/or the element (e.g., without limitation, stem; plunger; lever; paddle; arm) of such mechanism which moves in order to manipulate another component of the electrical switching apparatus.

As employed herein, the term "fastener" shall mean a separate element or elements which is/are employed to connect or tighten two or more components together, and expressly includes, without limitation, rivets, pins, screws, bolts and the combinations of bolts and nuts (e.g., without limitation, lock nuts) and bolts, washers and nuts.

As employed herein, the term "aperture" refers to any known or suitable passageway into or through a component and expressly includes, but is not limited to, openings, holes, gaps, slots, slits, recesses, and cut-outs.

As employed herein, the term "trip condition" refers to any electrical event that results in the initiation of a circuit breaker operation in which the separable contacts of the circuit breaker are tripped open, and expressly includes, but is not limited to, electrical fault conditions such as, for example, current overloads, short circuits, abnormal voltage and other fault conditions, receipt of an input trip signal, and a trip coil being energized.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
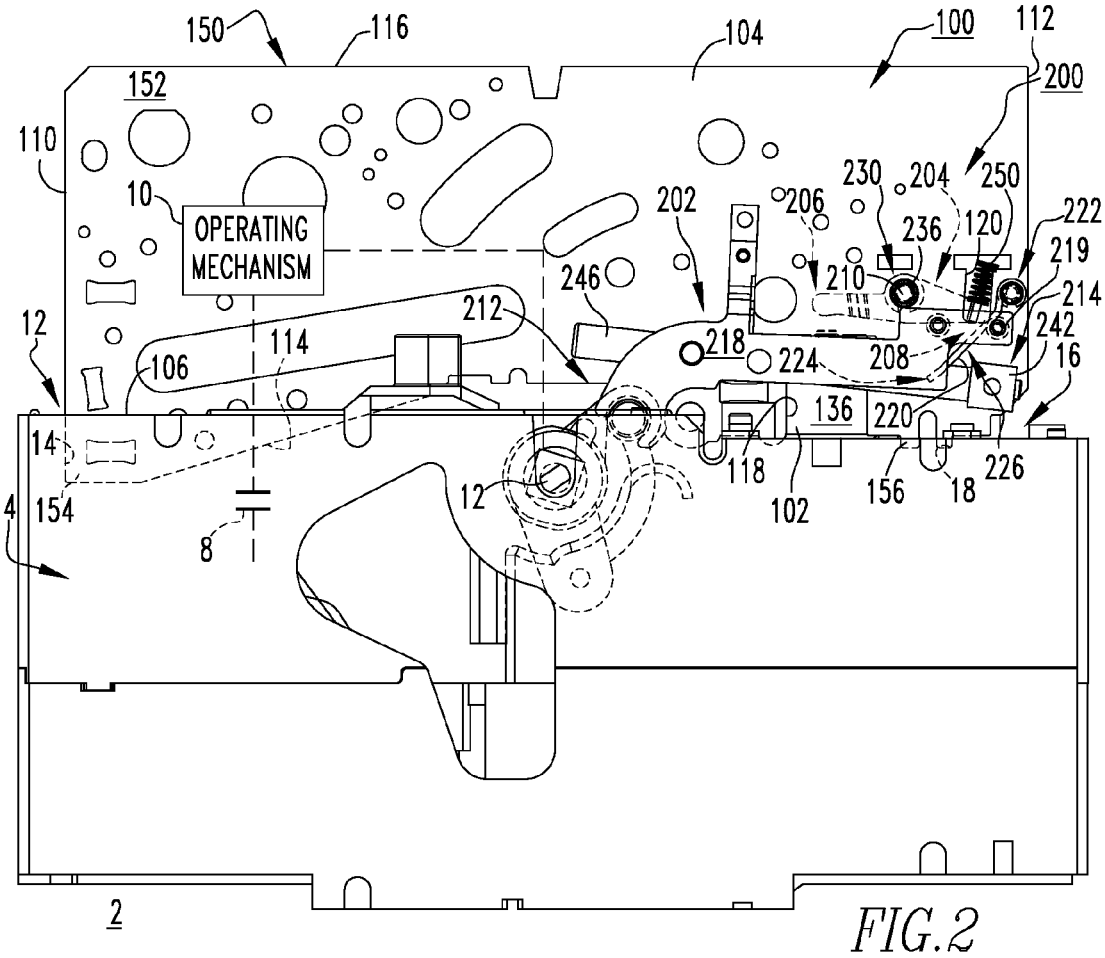
FIG. 2 is a side elevation view of the circuit breaker and trip actuator assembly therefor of FIG. 1, showing portions of the circuit breaker in block form.

FIG. 1 shows an electrical switching apparatus such as, for example, a low-voltage circuit breaker 2, and a trip actuator assembly 100 and a trip actuator reset assembly 200 therefor. The circuit breaker 2 includes a housing 4 having a mounting surface 6, separable contacts 8 (shown in simplified form in FIG. 2) enclosed by the housing 4, and an operating mechanism 10 (shown in simplified form in FIG. 2), which is structured to open and close the separable contacts 8 (FIG. 2).

The trip actuator assembly 100 includes a trip actuator 102 (e.g., without limitation, a solenoid 102), which is structured to be cooperable with the circuit breaker operating mechanism 10 (FIG. 2), and a planar member 104. The planar member 104 has first and second ends 110,112, first and second edges 114,116, and at least one aperture 118,120. The planar member 104 of the example circuit breaker 2 shown and described herein, is a first side plate 104 having first and second apertures 118,120. The example circuit breaker 2 also includes a second side plate 106. The trip actuator 102 is structured to be at least partially disposed within the first aperture 118 between the first side plate 104 and the mounting surface 6 of the housing 4. More specifically, the trip actuator 102 includes an enclosure 130 having a first end 132 with an actuating element 138 (e.g., without limitation, a plunger), and a second end 134 disposed opposite and distal from the first end 132. When the trip actuator 102 is removably coupled to the mounting surface 6 of the circuit breaker housing 4, as shown in FIG. 1 (see also FIG. 3), the first end 132 of the trip actuator enclosure 130 is engaged by the first side plate 104 at the aperture 118 thereof, and the second end 134 of the trip actuator enclosure 130 is disposed adjacent the mounting surface 6 of the circuit breaker housing 4.

Figure 3:
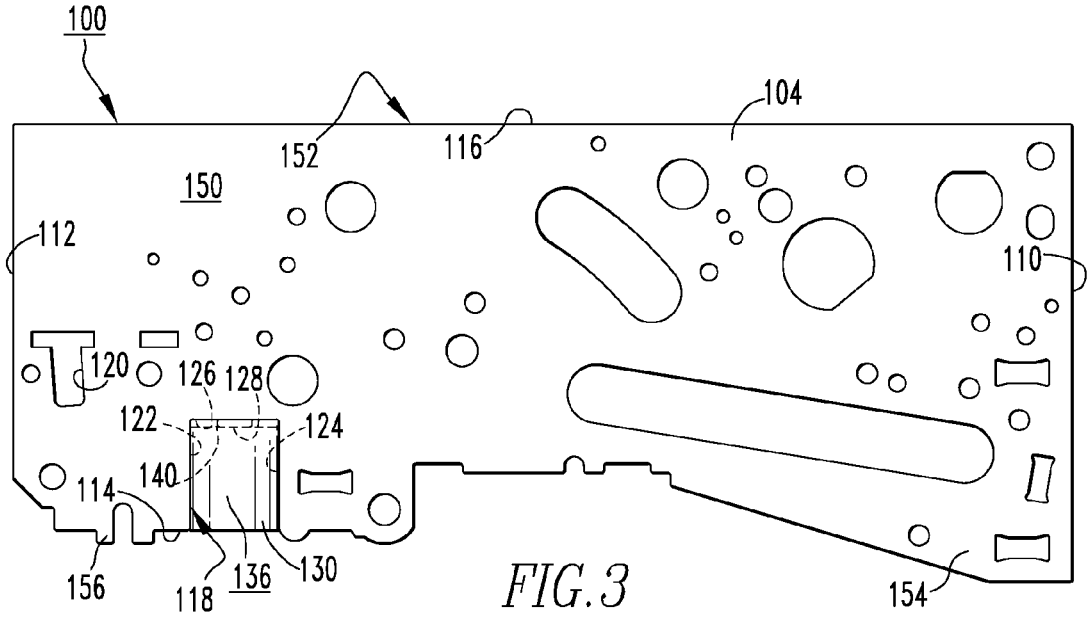
FIG. 3 is a side elevation view of the side plate and trip actuator of FIG. 2.
Figure 4:
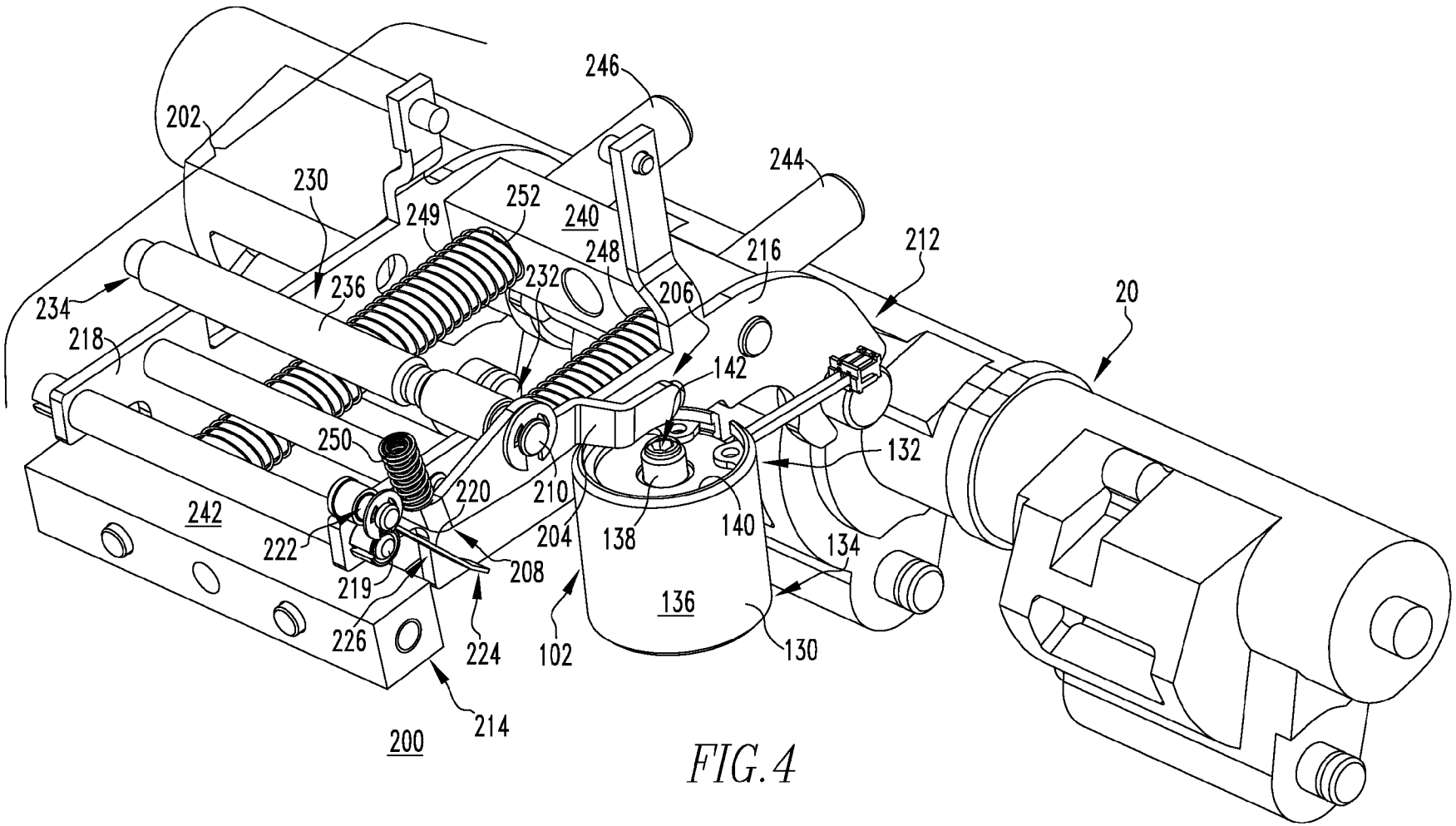
FIG. 4 is an isometric view of the trip actuator assembly of FIG. 1, also showing the pole shaft and cradle assembly of the circuit breaker operating mechanism.

The first end 132 of the trip actuator enclosure 130 further includes a recess 140, as shown in FIGS. 1, 3 (shown in hidden line drawing), 4 and 6. As shown in FIG. 3, the first aperture 118 of the example first side plate 104 is a cut-out having a first edge 122, a second edge 124, and a top 126. The top 126 of the first aperture 118 includes a protrusion 128 which extends into the recess 140 of the first end 132 of the trip actuator enclosure 130, in order to secure the trip actuator 102 within the first aperture 118. The first side plate 104 further includes a first side 150 and a second side 152, and the enclosure 130 of the trip actuator 102 further includes a body, which in the example shown and described herein is a cylinder 136. The cylinder 136 extends between the first and second ends 132,134 of the trip actuator enclosure 130, and extends through the first aperture 118 of the first side plate 104 in order to be disposed on both the first and second sides 150,152 of the first side plate 104. More specifically, the cylinder 136 has a center 142. The plunger 138 of the trip actuator 102 is disposed in the center 142 of the cylinder 136, as shown in FIGS. 1 and 4. The first portion of the cylinder 136, which is disposed on the first side 150 of the first side plate 104, is greater than the second portion of the cylinder 136, which is disposed on the second side 152 of the first side plate 104, in order that the plunger 138 is disposed on the first side 150 of the first side plate 104, as shown in FIG. 1.

In view of the foregoing, it will be appreciated that disclosed trip actuator assembly 100 effectively maintains the trip actuator 102 in a desired position within the circuit breaker 2. Specifically, it will be appreciated that the trip actuator 102 is secured directly by the first side plate 104 to the mounting surface 6 of the circuit breaker housing 4. Additionally, the first side plate 104 is preferably substantially flat and devoid of deformations (e.g., without limitation, bends). It will, therefore, be appreciated that the trip actuator 102 is secured directly by the first side plate 104, without requiring any intermediate component (e.g., without limitation, a mounting bracket), or, for example, a mounting flange. Thus, it is the first side plate 104 that, by itself, functions as the mounting element for precisely mounting the trip actuator 102 within the circuit breaker 2. This, along with the fact that circuit breaker components which interact with the trip actuator 102 (e.g., without limitation, the cradle assembly 202 and the reset lever 204 of the trip actuator reset assembly 200 discussed hereinbelow with respect to FIGS. 4, 5A, 5B), are directly coupled to the first side plate 104, results in precise, consistent operation of the trip actuator 102. In this manner, the disclosed trip actuator assembly 100 overcomes the aforementioned disadvantages (e.g., without limitation, misalignment) associated with known trip actuator assembly designs.

As an added benefit, the example trip actuator assembly 100 also reduces the number of components and/or fasteners required to accurately position the trip actuator 102 within the circuit breaker 2, and thereby further simplifies the installation, removal and/or maintenance of the trip actuator 102. Specifically, as will now be discussed, the first side plate 104 removably couples the trip actuator 102 to the circuit breaker housing 4, without a plurality of separate fasteners. In particular, as shown in FIGS. 1 and 2, the mounting surface 6 of the circuit breaker housing 4 includes a first end 12 having a first slot 14 (shown in hidden line drawing in FIG. 2), and a second end 16 disposed opposite and distal from the first end 12, and including a second slot 18 (shown in hidden line drawing in FIG. 2). Continuing to refer to FIGS. 1 and 2, and also to FIG. 3, it will be appreciated that the first edge 114 of the example first side plate 104 includes a first extension 154 (shown in hidden line drawing in FIG. 2) at or about the first end 110 of the first side plate 104, and a second extension 156 disposed at or about the second end 112 of the first side plate 104. The first extension 154 is structured to removably engage the first slot 14, of the circuit breaker housing 4, and the second extension 156 is structured to removably engage the second slot 18 of the circuit breaker housing 4. Accordingly, it will be appreciated that the first extension 154 of the example first side plate 104 is pivotable with respect to the first slot 14, in order that the second extension 156 can engage and disengage the second slot 18 to relatively easily secure and release, respectively, the trip actuator 102, as desired. It will, however, be appreciated that the first side plate 104 and, in particular, the first edge 114 of such side plate 104, could have any known or suitable alternative number and/or configuration of extensions (e.g., 154,156) or other suitable securing mechanism (not shown) structured to suitably engage the circuit breaker housing 4, without departing from the scope of the invention.

As will be described in greater detail hereinbelow, the example circuit breaker 2 further includes at least one linking member such as, for example and without limitation, the cradle assembly 202 of FIGS. 1, 2, 4, 5A, 5B and 5C (see also cradle assembly 302 of FIGS. 6, 7A, 7B and 7C) and the reset lever 204 of FIGS. 1, 2, 4, 5A, 5B and 5C (see also reset lever 304 of FIGS. 6, 7A, 7B and 7C). These components are coupled to the operating mechanism 10 (FIG. 2) and, in particular, the pole shaft 20 (shown in hidden line drawing in FIG. 2; see also FIGS. 4, 5A, 5B, 5C, 6, 7A, 7B and 7C) of the circuit breaker 2, and as previously discussed, are also coupled to the first side plate 104 of the example trip actuator assembly 100. As will be described in greater detail with respect to FIGS. 4, 5A, 5B and 5C, the reset lever 204 includes a first end 206, a second end 208, and a pivot 210 structured to pivotally couple the reset lever 204 to the first side 150 of the first side plate 104, as shown in FIG. 1. The cradle assembly 202 is disposed on the second side 152 of the first side plate 104, as shown in FIGS. 1 and 5C. The first end 206 of the reset lever 204 is cooperable with the plunger 138 of the trip actuator 102 on the first side 150 of the first side plate 104. The second end 208 of the example reset lever 204 extends through the second aperture 120 of the first side plate 104 and cooperates with a portion of the cradle assembly 202 on the second side 152 of the first side plate 104, as will be discussed.

In order to further secure the trip actuator 102 in the desired position with respect to the circuit breaker 2 and, in particular, the operating mechanism 10 (FIG. 2), the mounting surface 6 of the housing 4 of the example circuit breaker 2 further includes a number of outwardly extending protrusions 30,32 (FIG. 1). When the trip actuator 102 is removably coupled to the mounting surface 6, the body 136 of the trip actuator enclosure 130, at or about the second end 134 thereof, is secured by at least one of the outwardly extending protrusions 30,32. Two molded protrusions 30,32, which extend outwardly from the mounting surface 6, are shown securing the second end 134 of the trip actuator enclosure 130 in the example of FIG. 1. It will, however, be appreciated that any known or suitable alternative number and/or configuration of protrusions or other suitable securing mechanism (not shown) could be employed, without departing from the scope of the invention. It will also be appreciated that the trip actuator 102 may, for example, "snap" into position between a suitable number of protrusions (e.g., 30,32) to be secured. The example protrusion 32 further includes a hole 34, and receives a fastener, such as the screw 36 shown in exploded orientation in FIG. 1. The screw 36 is fastenable within the hole 34 to further secure the trip actuator 102.

The housing 4 of the example circuit breaker 2 also includes an accessory tray 40 which, for economy of disclosure, is shown in simplified form in phantom line drawing in FIG. 1. The accessory tray 40 is insertable on the mounting surface 6 of the housing 4, as shown, and is also removable. When the accessory tray 40 is inserted (shown), it abuts the body 136 of the trip actuator enclosure 130, in order to further secure the trip actuator 102 in the desired position. More specifically, the accessory tray 40 includes first and second edges 42,44. The first edge 42 has an arcuate recess 46 corresponding to the cylindrical body 136 of the trip actuator enclosure 130. Accordingly, when the accessory tray 40 is inserted, as shown in FIG. 1, the arcuate recess 46 of the accessory tray 40 engages and secures a portion of the cylindrical body 136.

In view of the foregoing, it will be appreciated that the disclosed trip actuator assembly 100 functions to removably secure the trip actuator 102 in a precise orientation within the circuit breaker 2 (FIGS. 1 and 2). In addition to the aforementioned advantages (e.g., without limitation, precise alignment; consistent operation of the trip actuator), precise mounting of the trip actuator 102 also helps to ensure that the trip actuator 102 is effectively and consistently reset following a trip of the circuit breaker 2 in response to a trip condition, as will now be discussed.

FIGS. 4, 5A, 5B and 5C, show the trip actuator reset assembly 200 for the circuit breaker 2. Specifically, the trip actuator reset assembly 200 includes the aforementioned cradle assembly 202, reset lever 204, and trip actuator 102, as well as a resilient element 220, and a guide member 230. The cradle assembly includes a first end 212, which is pivotally coupled to the pole shaft 20 of the circuit breaker 2 (FIGS. 1 and 2), and a second end 214 disposed opposite and distal from the first end 212. The cradle assembly 202 is movable among a first position (FIGS. 4 and 5A; see also first position of cradle assembly 302 of FIG. 7A) corresponding to the separable contacts 8 (FIG. 2) of the circuit breaker 2 (FIGS. 1 and 2) being closed, and a second position (FIGS. 5B and 5C; see also second position of cradle assembly 302 of FIGS. 7B and 7C) corresponding to the separable contacts 8 (FIG. 2) being open. In response to the trip condition, the plunger 138 of the trip actuator 102 is structured to move (upward with respect to FIG. 5A) the first end 206 of the reset lever 204. Subsequently, the trip actuator 102 must be reset.

The resilient element 220 is pivotally coupled to the circuit breaker housing 4 (FIG. 1). In the example shown and described herein, the resilient element 220 is a leaf spring having a first end 222 pivotally coupled to the second side 152 of the first side plate 104 proximate the second end 208 of the reset lever 204. The second end 224 of the leaf spring 220 is disposed opposite and distal from the first end 222, and an intermediate portion 226 of the leaf spring 220 is disposed between the first and second ends 222,224. When the cradle assembly 202 moves (e.g., pivots clockwise with respect to FIG. 5A) from the first position (FIGS. 4 and 5A) toward the second position (FIGS. 5B and 5C), the guide member 230 guides the cradle assembly 202 into engagement with the resilient element 220, which pivots the reset lever 204. More specifically, the cradle assembly 202 is pulled by the pole shaft 20 and, in response, has a tendency to pivot. However, when the cradle assembly 202 begins to pivot, the top edges of the first and second sides 216,218 (both shown in FIGS. 1 and 4) engage the guide member 230, which prevents it from continuing to pivot, instead forcing it to slide into engagement with the resilient element 220, as shown in FIG. 4. In particular, a protrusion 219, which extends outwardly from the first side 216 of the cradle assembly 202 engages and moves the resilient element 220. The resilient element 220 then pivots the reset lever 204 such that the first end 206 of the reset lever 204 depresses the plunger 138 of the trip actuator 102, thereby resetting the trip actuator 102. After the trip actuator 102 has been reset, if the cradle assembly 202 has a tendency to continue to move beyond the second position (FIGS. 5B and 5C), the intermediate portion 226 of the resilient element 220 bends, as shown in exaggerated form in FIGS. 5B and 5C. In this manner, the resilient element 220 (e.g., without limitation, leaf spring) accommodates any additional energy and associated motion (e.g., over-rotation) that the cradle assembly 202 may have. Accordingly, the disclosed trip actuator reset assembly 200 overcomes the aforementioned disadvantages (e.g., without limitation, over-rotation; damage to the plunger 138) associated with known trip actuator reset assemblies.

More specifically, as shown in FIGS. 1 and 4, the guide member 230 includes first and second ends 232,234, and in an elongated body 236 extending therebetween. The elongated body 236 extends between the first and second side plates 104,106 of the circuit breaker 2, as shown in FIG. 1. The example reset lever 204 further includes a bias element such as, for example and without limitation, the spring 250, which is shown. The bias element 250 is structured to bias the second end 208 of the reset lever 204, in order to bias and thus pivot (e.g., counterclockwise from the perspective of FIGS. 4, 5A and 5B; clockwise from the perspective of FIG. 5C) the first end 206 of the reset lever 204, toward the position shown in FIGS. 4 and 5A. As partially shown in simplified form in phantom line drawing in FIG. 5C, the example bias element 250 is disposed within the second aperture or hole 120 of the first side plate 104 (see also FIGS. 1 and 2). In this manner, the first end 206 of the reset lever 204 is biased away from the plunger 138 of the trip actuator 102.

The aforementioned first side 216 (FIGS. 4, 5A and 5B) of the cradle assembly 202 extends from the pole shaft 20 toward the second end 214 of the cradle assembly 202. The example cradle assembly 202 also includes a second side 218 (FIG. 5C), which is disposed opposite and spaced apart from the first side 216. A first cross member 240, which is disposed proximate the first end 212 of the cradle assembly 202, extends between the first and second sides 216,218, and is structured not to move independently with respect to the first and second sides 216,218. A second cross member 242 is disposed at or about the second end 214 of the cradle assembly 202, and is structured to extend between, and be pivotally coupled to, the first and second side plates 104,106 of the circuit breaker 2 (FIGS. 1 and 2). Thus, the second cross member 242 provides a fixed pivot point for the cradle assembly 202 with respect to the first and second side plates 104, 106, and the trip actuator 102. At least one elongated member such as, for example and without limitation, the first and second rods 244,246 shown in FIG. 4, is/are fixedly coupled to the second cross member 242, and extend through the first cross member 240. Specifically, as will be appreciated with reference to second rod 246 of FIG. 4, each of the example elongated members 244,246 extend through a corresponding thru hole (only one thru hole 252 is shown in FIG. 4; see also rods 344,346 extending through thru holes 351,352 in FIG. 6) in the first cross member 240 of the cradle assembly 202. It will, therefore, be appreciated that a portion (e.g., without limitation, first and second sides 216,218; pivot 219; first cross member 240) of the cradle assembly 202 can move on the elongated members 244,246 with respect to a second portion (e.g., without limitation, second cross member 242) of the cradle assembly 202, in order to accommodate movement of the pole shaft 20 and/or cradle assembly 202, for example, during a reset operation of the trip actuator 102.

In the example of FIG. 4, the first and second rods 244,246 further include first and second springs 248,249, respectively. The springs 248,249 are disposed between the first and second cross members 240,242 of the cradle assembly 202, and the rods 244,246 pass through the coils of the springs 248, 249, respectively. The springs 248,249 have a tendency to bias the cradle assembly 202 toward the second position (FIGS. 5B and 5C; see also cradle assembly 302 shown in the second position in FIGS. 7B and 7C). It will, however, be appreciated that such springs (e.g., 248,249) shown and described with respect to FIG. 4 are not intended to be a limiting element of the disclosed trip actuator reset assembly 200. For example, the cradle assembly 202 could be devoid of such springs, without departing from the scope of the invention.

Figure 5A:
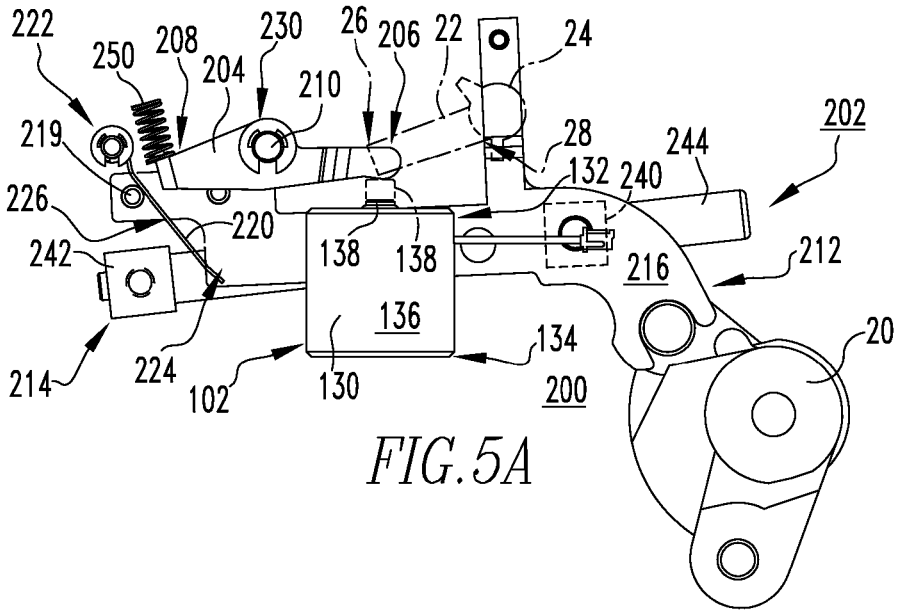
FIG. 5A is a right side elevation view of the trip actuator assembly, and pole shaft and cradle assembly of FIG. 4, with each component shown in its respective position corresponding to the circuit breaker being closed.
Figure 5B:
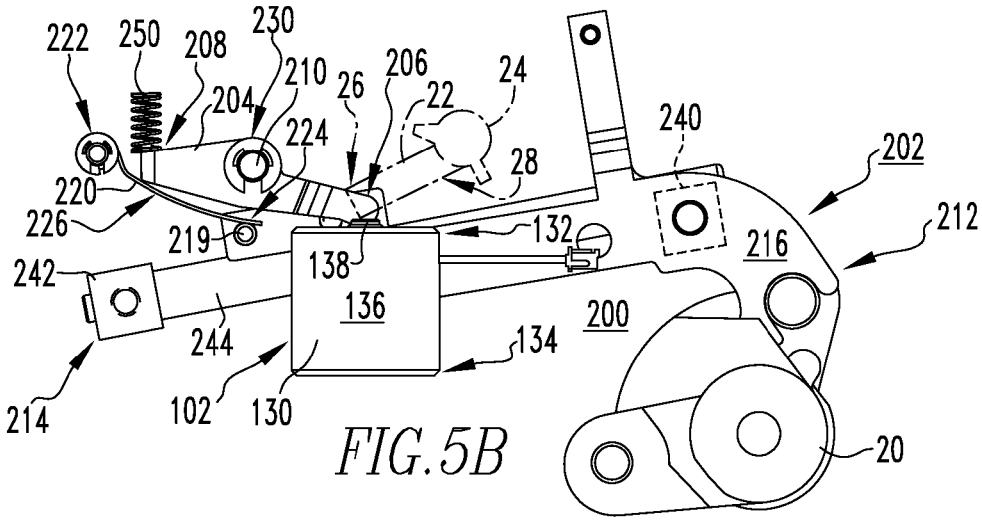
FIGS. 5B and 5C are right and left side elevation views, respectively, of the trip actuator assembly, and pole shaft and cradle assembly of FIG. 5A, modified to show each component in its respective position corresponding to the circuit breaker being open.
Figure 5C:
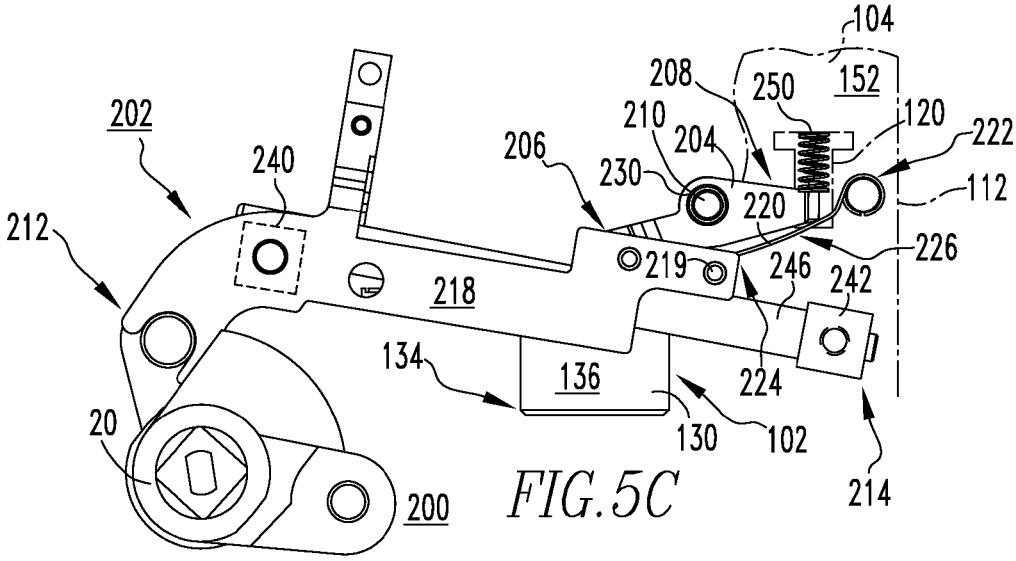
Figure 7A:
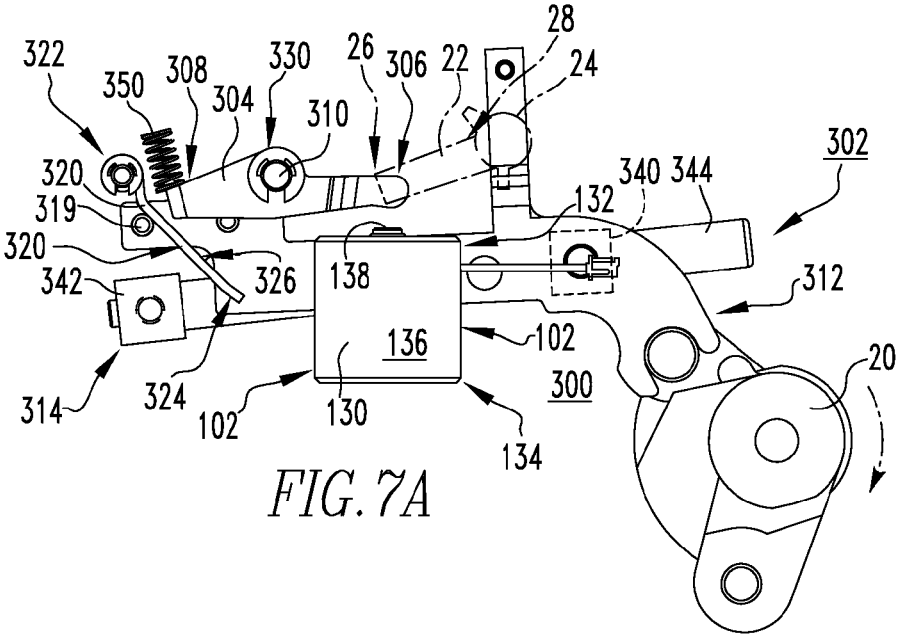
FIG. 7A is a right side elevation view of the trip actuator assembly, and pole shaft and cradle assembly of FIG. 6, with each component shown in its respective position corresponding to the circuit breaker being closed.
Figure 7B:
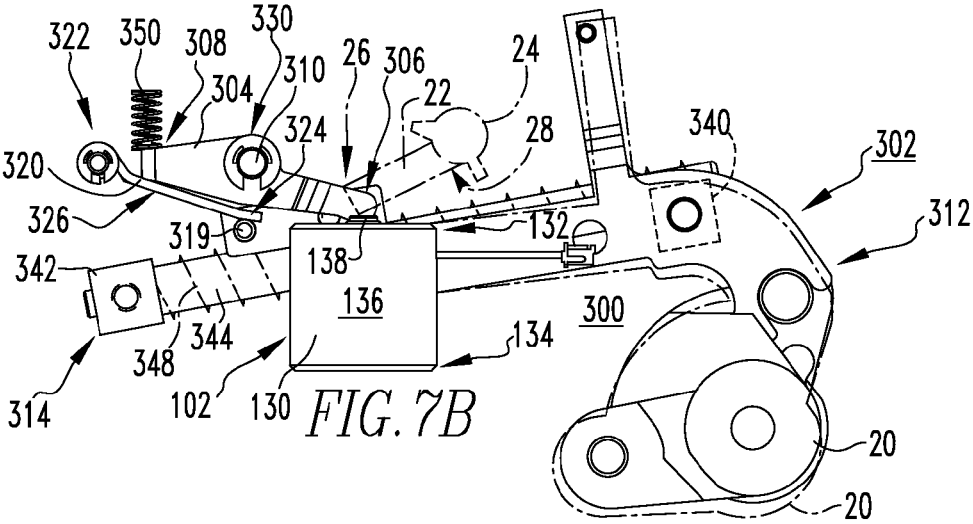
FIGS. 7B and 7C are right and left side elevation views, respectively, of the trip actuator assembly, and pole shaft and cradle assembly of FIG. 7A, modified to show each component in its respective position corresponding to the circuit breaker being open.
Figure 7C:
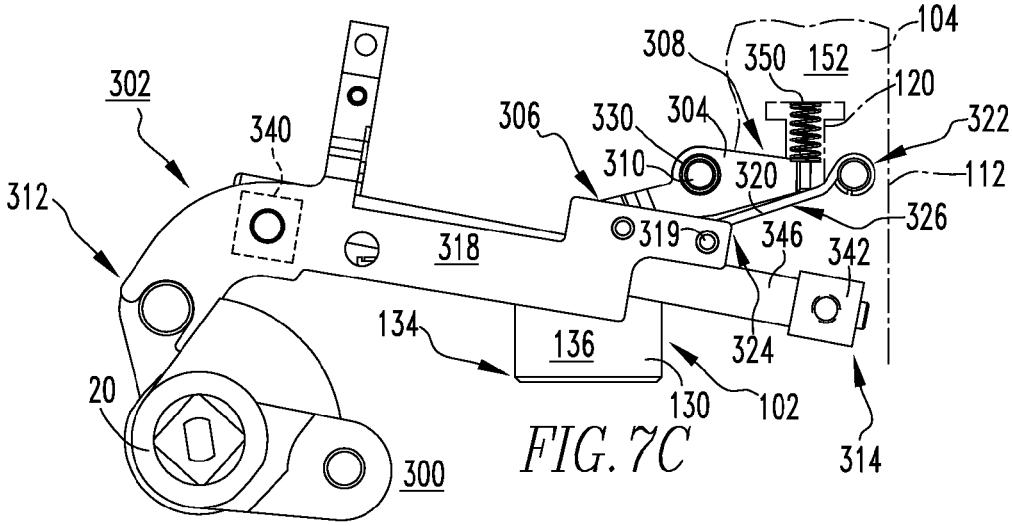

The operating mechanism 10 (shown in simplified form in FIG. 2) of the example circuit breaker 2 (FIGS. 1 and 2) further includes a trip bar 24 and trip lever 22, both of which are shown in simplified form in phantom line drawing in FIGS. 1, 5A and 5B (see also FIGS. 7A and 7B). The trip lever 22 includes a first end 26, which overlays the plunger 138 of the trip actuator 102, and a second end 28, which is coupled to the trip bar 24. The first end 26 of the example trip lever 22 is also cooperable with the first end 206 of the reset lever 204 of the trip actuator reset assembly 200, in order that the trip lever 22 and reset lever 204 are movable together in certain modes of operation (e.g., when the plunger 138 of the trip actuator 102 pushes them, as shown in phantom line drawing in FIG. 5A). More specifically, as partially shown in phantom line drawing in FIG. 1, the example trip lever 22 is structured to overlay (e.g., without limitation, straddle) the first end 206 of the reset lever 204.

An operation of the trip actuator reset assembly 200 to reset the trip actuator 102 following a trip condition, will now be discussed with reference to FIGS. 5A, 5B and 5C. It will be appreciated that except for the distinctions discussed herein, the trip actuator reset assembly 300 discussed hereinbelow with respect to FIGS. 6, 7A, 7B and 7C functions in substantially the same manner. Specifically, as previously discussed, the example trip actuator is a solenoid 102 having as its actuating element, a plunger 138. In response to the trip condition, the plunger 138 extends in order to pivot the reset lever 204 and the trip lever 22, as shown in phantom line drawing in FIG. 5A. After the trip condition, the plunger 138 remains extended until it is depressed by the reset lever 204 in order to reset the trip actuator 102 and the trip lever 22. Specifically, to begin a reset operation, during which the pole shaft 20 and cradle assembly 202 move from the position shown in FIG. 5A toward the position shown in FIGS. 5B and 5C, the protrusion 219 of the cradle assembly 202 engages the resilient element 220 (e.g., without limitation, leaf spring) and pivots it about its first end 222, as previously discussed. The intermediate portion 226 of the resilient element 220 then engages the second end 208 of the reset lever 204, thereby pivoting the reset lever 204 until the first end 206 of the reset lever 204 engages and depresses the plunger 138, as shown in FIG. 5B. When the plunger 138 is fully depressed, the trip actuator 102 is reset. Simultaneously, the trip lever 22, which in the example shown and described herein is cooperable with (e.g., overlays) the reset lever 204, is also reset.

Unique to the disclosed trip actuator reset assembly 200 is that, after the trip actuator 102 is reset, if the cradle assembly 202 has a tendency to continue to move, for example, thereby having a tendency to over-rotate the reset lever 204 and potentially damage the plunger 138 and/or trip actuator 102 or a component (e.g., without limitation, cradle assembly 202) of the trip actuator reset assembly 200, the intermediate portion 226 of the resilient element 220 advantageously bends to absorb such movement, as previously discussed. The disclosed trip indicator reset assembly 200, therefore, resists undesirable consequences, for example, associated with over-rotation of the cradle assembly 202.

It will, however, be appreciated that the trip actuator reset assembly (e.g., 200) and components (e.g., without limitation cradle assembly 202; reset lever 204; resilient element 220) could comprise any known or suitable alternative configuration. For example, FIGS. 6, 7A, 7B and 7C show a trip actuator reset assembly 300 which is substantially similar to the trip actuator reset assembly 200 discussed with respect to FIGS. 4, 5A, 5B and 5C, but includes a rigid element 320 as opposed to the resilient element 220 of trip actuator reset assembly 200. It will be appreciated that like features of the trip actuator reset assembly 300 are numbered substantially the same as those previously discussed with respect to trip actuator reset assembly 200, but using 300 series reference numbers instead of 200 series reference numbers. For example, the cradle assembly 302, includes first and second ends 312,314, first and second sides 316,318, first and second cross members 340,342, and first and second rods 344,346, all of which are substantially similar to the same features previously discussed in connection with trip actuator reset assembly 200 of FIGS. 4, 5A, 5B and 5C. For economy of disclosure, certain aspects of the trip actuator reset assembly 300 which are substantially the same as trip actuator reset assembly 200, discussed hereinabove, will not be repetitively discussed.

Figure 6:
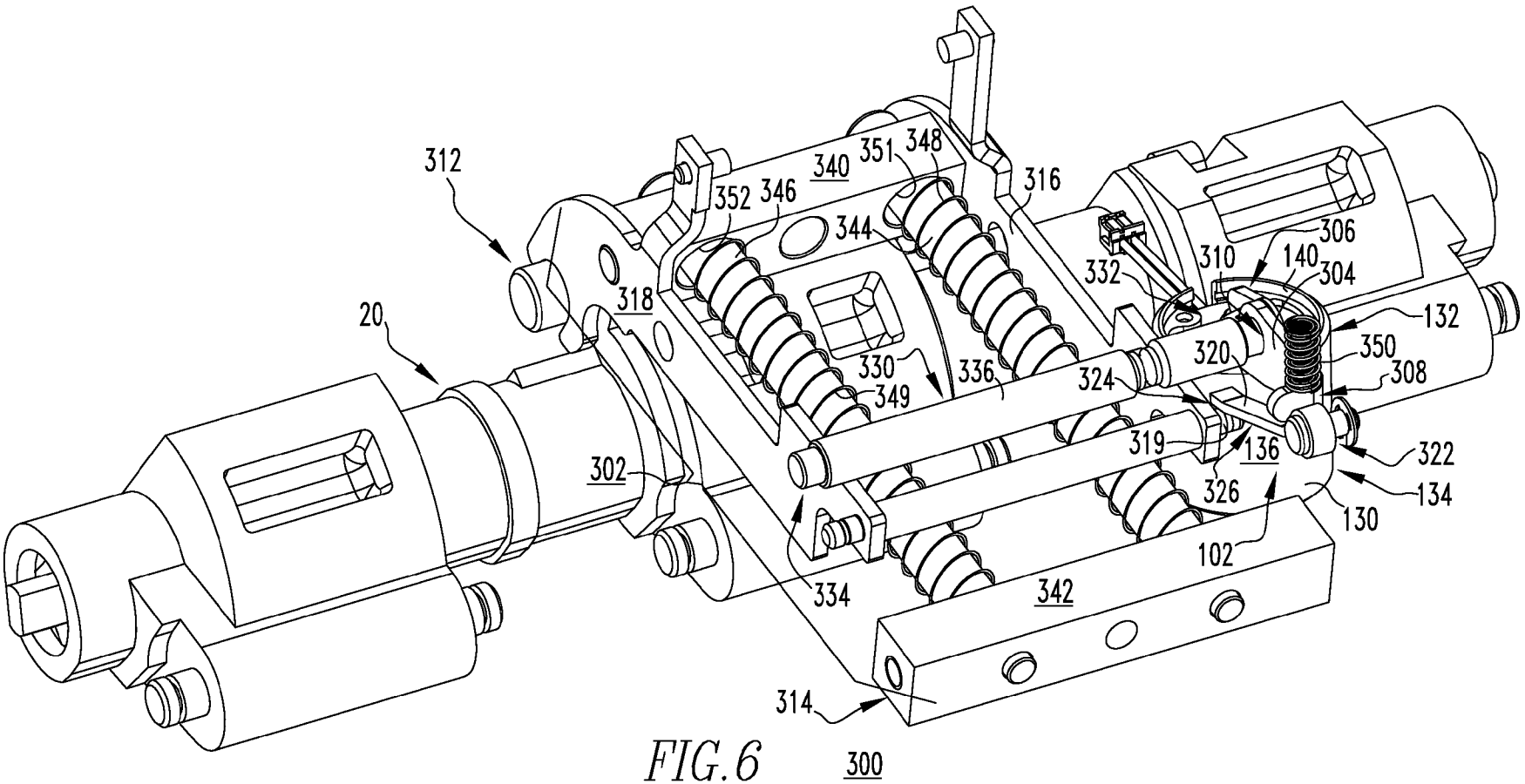
FIG. 6 is an isometric view of a trip actuator assembly in accordance with another embodiment of the invention, also showing the pole shaft and cradle assembly of the circuit breaker operating mechanism.

In addition to the distinction of the rigid element 320 which, unlike the aforementioned resilient element 220 (e.g., without limitation, leaf spring) is not intended to bend or otherwise deflect, the trip actuator reset assembly 300 is further different from trip actuator reset assembly 200 in that the springs 348,349 or suitable equivalent resilient element(s) is/are required elements of the cradle assembly 302. This is because any additional movement (e.g., without limitation, over-rotation) of, for example, the cradle assembly 302, that is experienced during the reset operation, must be accommodated by the springs 348,349. In other words, after the trip actuator 102 has been reset, if the cradle assembly 302 continues to move beyond the second position, as shown in phantom line drawing in FIG. 7B, then the springs 348,349 (both are shown in FIG. 6) of the cradle assembly 302 flex (e.g., extend) to accommodate the additional motion, and thereby resist damage to components of the trip actuator reset assembly 300 such as, for example and without limitation, the plunger 138, the trip actuator 102, the reset lever 304 and/or the cradle assembly 302. Thus, as will be appreciated by comparing FIG. 7B to FIG. 5B, previously discussed in connection with trip actuator reset assembly 200, rather than bending or otherwise deflecting the resilient element 220, as shown in exaggerated form in FIG. 5B, in order to absorb additional motion of the cradle assembly 202, the intermediate portion 326 of the rigid element 320 of the example of FIG. 7B does not bend or otherwise deflect. Instead, the cradle assembly 302 itself and, in particular, the springs 348, 349 thereof, absorb the additional movement. It will be appreciated that the remainder of the operation of trip actuator reset assembly 300 to reset the trip actuator 102 and trip lever 22 is substantially the same as for trip actuator reset assembly 200, previously discussed. It will also be appreciated that, rather than, or in addition to, the springs 348,349, the opening spring (not shown) of the circuit breaker (FIGS. 1 and 2) could be employed to accommodate the excess movement of the cradle assembly 302, for example, by allowing the cradle assembly 302 to flex.

It will, therefore, be appreciated that the disclosed trip actuator reset assemblies 200,300 can accommodate, for example and without limitation, misalignment and/or over-rotation associated therewith, in order to effectively, consistently reset the trip actuator 102 of the circuit breaker (FIGS. 1 and 2). It will also be appreciated that the components of the trip actuator reset assemblies 200,300 could be shaped and configured in a wide variety of alternative arrangements (not shown) in order to achieve this goal in accordance with the invention. For example, although the rigid element 320 shown and described in the example of FIGS. 6, 7A, 7B and 7C is an elongated member having a first end 322 pivotally coupled to the second side 152 of the first side plate 104 (shown in phantom line drawing in FIG. 7C), a second end 324 disposed opposite and distal from the first end 322, and the intermediate portion 326 therebetween, it could alternatively have any suitable shape and/or configuration (not shown). For instance, a protrusion (not shown) of the cradle assembly (e.g., 302) itself could pivot the reset lever 304, thus eliminating the need for a separate rigid element (e.g., 320).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A trip actuator reset assembly for an electrical switching apparatus including a housing, separable contacts enclosed by said housing, and an operating mechanism structured to open and close said separable contacts, said operating mechanism including a pole shaft, said trip actuator reset assembly comprising:

a cradle assembly including a first end structured to be pivotably coupled to said pole shaft, and a second end disposed opposite and distal from the first end, said cradle assembly being structured to be movable among a first position corresponding to said separable contacts being closed, and a second position corresponding to said separable contacts being open;

a reset lever including a first end, a second end disposed opposite and distal from the first end of said reset lever, and a pivot structured to pivotably couple said reset lever to said housing;

a trip actuator including an actuating element which, in response to a trip condition, is structured to move the first end of said reset lever;

a resilient element structured to be pivotably coupled to said housing proximate the second end of said reset lever; and a guide member, wherein, after said trip condition, said actuating element of said trip actuator is structured to be reset, wherein, when said cradle assembly moves from said first position toward said second position, said guide member guides said cradle assembly into engagement with said resilient element which pivots said reset lever, wherein, when said resilient element pivots said reset lever, the first end of said reset lever moves said actuating element of said trip actuator, thereby resetting said trip actuator, and wherein, after said trip actuator has been reset, if said cradle assembly continues to move beyond said second position, then said resilient element bends to accommodate any additional motion of said cradle assembly.

2. The trip actuator reset assembly of claim 1 wherein said housing of said electrical switching apparatus includes a mounting surface, a first side plate extending outwardly from said mounting surface, and a second side plate extending outwardly from said mounting surface; wherein said guide member includes a first end, a second end disposed opposite and distal from the first end of said guide member, and an elongated body extending between the first end of said guide member and the second end of said guide member; and wherein said elongated body is structured to extend between said first side plate and said second side plate.

3. The trip actuator reset assembly of claim 2 wherein said first side plate includes a first side and a second side; wherein said actuating element of said trip actuator is structured to be disposed on the first side of said first side plate; and wherein said pivot of said reset lever is structured to be pivotably coupled to the first end of said guide member at or about the first side of said first side plate.

4. The trip actuator reset assembly of claim 3 wherein said reset lever further includes a bias element; wherein said first side plate further includes a hole; wherein the second end of said reset lever is structured to extend from the first side of said first side plate through said hole of said first side plate and beyond the second side of said first side plate; and wherein said bias element is structured to be disposed within said hole of said first side plate, in order to bias the second end of said reset lever away from said actuating element of said trip actuator.

5. The trip actuator reset assembly of claim 3 wherein said cradle assembly comprises a first side structured to extend from said pole shaft toward the second end of said cradle assembly, a second side disposed opposite and spaced from the first side of said cradle assembly, a first cross member disposed proximate the first end of said cradle assembly, a second cross member disposed at or about the second end of said cradle assembly, and at least one elongated member fixedly coupled to said second cross member and extending through said first cross member; wherein said first cross member extends between the first side of said cradle assembly and the second side of said cradle assembly; wherein said first cross member does not move independently with respect to the first side of said cradle assembly and the second side of said cradle assembly; and wherein said second cross member is structured to extend between and be pivotably coupled to said first side plate and said second side plate, thereby providing a fixed pivot point for said cradle assembly with respect to said first side plate and said second side plate.

6. The trip actuator assembly of claim 5 wherein, when said cradle assembly is moved toward said second position, the first side of said cradle assembly, the second side of said cradle assembly, and said first cross member extending therebetween are movable with respect to said second cross member and said at least one elongated member fixedly coupled to said second cross member.

7. The trip actuator assembly of claim 6 wherein said at least one elongated member is a first rod and a second rod; wherein said cradle assembly further comprises a first spring disposed on said first rod, and a second spring disposed on said second rod; and wherein said first spring and said second spring bias said cradle assembly toward said second position.

8. The trip actuator reset assembly of claim 5 wherein the first side of said cradle assembly further comprises a protrusion extending outwardly from the first side of said cradle assembly toward said first side plate; wherein said resilient element is pivotably coupled to the second side of said first side plate; and wherein, when said cradle assembly moves toward said second position, said protrusion engages and moves said resilient element.

9. The trip actuator reset assembly of claim 8 wherein said operating mechanism of said electrical switching apparatus further includes a trip lever; and wherein, when said protrusion engages and moves said resilient element and said cradle assembly continues to move toward said second position, said resilient element engages the second end of said reset lever and pivots said reset lever about said pivot, in order that the first end of said reset lever moves said actuating element of said trip actuator.

10. A trip actuator reset assembly for an electrical switching apparatus including a housing, separable contacts enclosed by said housing, and an operating mechanism structured to open and close said separable contacts, said operating mechanism including a pole shaft, said trip actuator reset assembly comprising:

a cradle assembly including a first end structured to be pivotably coupled to said pole shaft, and a second end disposed opposite and distal from the first end, said cradle assembly being structured to be movable among a first position corresponding to said separable contacts being closed, and a second position corresponding to said separable contacts being open;

a reset lever including a first end, a second end disposed opposite and distal from the first end of said reset lever, and a pivot structured to pivotably couple said reset lever to said housing;

a trip actuator including an actuating element which, in response to a trip condition, is structured to move the first end of said reset lever;

a resilient element structured to be pivotably coupled to said housing proximate the second end of said reset lever; and a guide member, wherein, after said trip condition, said actuating element of said trip actuator is structured to be reset, wherein, when said cradle assembly moves from said first position toward said second position, said guide member guides said cradle assembly into engagement with said resilient element which pivots said reset lever, wherein, when said resilient element pivots said reset lever, the first end of said reset lever moves said actuating element of said trip actuator, thereby reselling said trip actuator, wherein, after said trip actuator has been reset, if said cradle assembly continues to move beyond said second position, then said resilient element bends to accommodate any additional motion of said cradle assembly, and wherein said actuating element of said trip actuator is a plunger; wherein, in response to said trip condition, said plunger is structured to extend in order to pivot said reset lever and said trip lever; and wherein, after said trip condition, said plunger remains extended until it is depressed by said reset lever in order to reset said trip actuator and said trip lever.

11. The trip actuator reset assembly of claim 10 wherein said resilient element is a leaf spring having a first end pivotably coupled to the second side of said first side plate, a second end disposed opposite and distal from the first end, and an intermediate portion extending between the first end and the second end; wherein, when said cradle assembly is moved toward said second position, said intermediate portion of said resilient element engages the second end of said reset lever, thereby pivoting said reset lever; wherein, as said cradle assembly moves into said second position, said reset lever is structured to continue to pivot until the first end of said reset lever completely depresses said plunger, thereby resetting said trip actuator and said trip lever; and wherein, after said trip actuator is reset, if said cradle assembly continues to move, then said intermediate portion of said resilient element bends to absorb such movement.

12. An electrical switching apparatus comprising:

a housing;

separable contacts enclosed by said housing;

an operating mechanism structured to open and close said separable contacts, said operating mechanism including a pole shaft; and a trip actuator reset assembly comprising:

a cradle assembly including a first end pivotably coupled to said pole shaft, and a second end disposed opposite and distal from the first end, said cradle assembly being movable among a first position corresponding to said separable contacts being closed, and a second position corresponding to said separable contacts being open, a reset lever including a first end, a second end disposed opposite and distal from the first end of said reset lever, and a pivot pivotably couple said reset lever to said housing, a trip actuator including an actuating element which, in response to a trip condition, moves the first end of said reset lever, a resilient element pivotably coupled to said housing proximate the second end of said reset lever, and a guide member, wherein, after said trip condition, said actuating element of said trip actuator must be reset, wherein, when said cradle assembly moves from said first position toward said second position, said guide member guides said cradle assembly into engagement with said resilient element which pivots said reset lever, wherein, when said resilient element pivots said reset lever, the first end of said reset lever moves said actuating element of said trip actuator, thereby resetting said trip actuator, and wherein, after said trip actuator has been reset, if said cradle assembly continues to move beyond said second position, then said resilient element bends to accommodate any additional motion of said cradle assembly.

13. The electrical switching apparatus of claim 12 wherein said housing of said electrical switching apparatus includes a mounting surface, a first side plate extending outwardly from said mounting surface, and a second side plate extending outwardly from said mounting surface; wherein said guide member of said trip actuator reset assembly includes a first end, a second end disposed opposite and distal from the first end of said guide member, and an elongated body extending between the first end of said guide member and the second end of said guide member; and wherein said elongated body extends between said first side plate and said second side plate.

14. The electrical switching apparatus of claim 13 wherein said first side plate includes a first side and a second side; wherein said actuating element of said trip actuator is disposed on the first side of said first side plate; and wherein said pivot of said reset lever is pivotably coupled to the first end of said guide member at or about the first side of said first side plate.

15. The electrical switching apparatus of claim 14 wherein said reset lever further includes a bias element; wherein said first side plate further includes a hole; wherein the second end of said reset lever extends from the first side of said first side plate through said hole of said first side plate and beyond the second side of said first side plate; and wherein said bias element is disposed within said hole of said first side plate, in order to bias the second end of said reset lever away from said actuating element of said trip actuator.

16. The electrical switching apparatus of claim 14 wherein said cradle assembly comprises a first side extending from said pole shaft toward the second end of said cradle assembly, a second side disposed opposite and spaced from the first side of said cradle assembly, a first cross member disposed proximate the first end of said cradle assembly, a second cross member disposed at or about the second end of said cradle assembly, and at least one elongated member fixedly coupled to said second cross member and extending through said first cross member; wherein said first cross member extends between the first side of said cradle assembly and the second side of said cradle assembly; wherein said first cross member does not move with respect to the first side of said cradle assembly and the second side of said cradle assembly; and wherein said second cross member is structured to extend between and be pivotably coupled to said first side plate and said second side plate, thereby providing a fixed pivot point for said cradle assembly with respect to said first side plate and said second side plate.

17. The electrical switching apparatus of claim 16 wherein, when said cradle assembly is moved toward said second position, the first side of said cradle assembly, the second side of said cradle assembly, and said first cross member extending therebetween are movable with respect to said second cross member and said at least one elongated member fixedly coupled to said second cross member.

18. The electrical switching apparatus of claim 17 wherein said at least one elongated member is a first rod and a second rod; wherein said cradle assembly further comprises a first spring disposed on said first rod, and a second spring disposed on said second rod; and wherein said first spring and said second spring bias said cradle assembly toward said second position.

19. The electrical switching apparatus of claim 16 wherein the first side of said cradle assembly further comprises a protrusion extending outwardly from the first side of said cradle assembly toward said first side plate; wherein said resilient element is pivotably coupled to the second side of said first side plate; wherein, when said cradle assembly moves toward said second position, said protrusion engages and moves said resilient element; and wherein, when said protrusion engages and moves said resilient element and said cradle assembly continues to move toward said second position, said resilient element engages the second end of said reset lever and pivots said reset lever about said pivot, in order that the first end of said reset lever moves said actuating element of said trip actuator.

20. The electrical switching apparatus of claim 19 wherein said actuating element of said trip actuator is a plunger; wherein, in response to said trip condition, said plunger extends in order to move said reset lever and said trip lever; wherein, after said trip condition, said plunger remains extended until it is depressed by said reset lever in order to reset said trip actuator and said trip lever; wherein said resilient element is a leaf spring having a first end pivotably coupled to the second side of said first side plate, a second end disposed opposite and distal from the first end, and an intermediate portion extending between the first end and the second end; wherein, when said cradle assembly is moved toward said second position, said intermediate portion of said resilient element engages the second end of said reset lever, thereby pivoting said reset lever; wherein, as said cradle assembly moves into said second position, said reset lever continues to pivot until the first end of said reset lever completely depresses said plunger, thereby resetting said trip actuator and said trip lever; and wherein, after said trip actuator is reset, if said cradle assembly continues to move, then said intermediate portion of said resilient element bends to absorb such movement.

21. The electrical switching apparatus of claim 12 wherein said electrical switching apparatus is a circuit breaker; wherein said operating mechanism of said circuit breaker further comprises a trip bar and a trip lever extending outwardly from said trip bar; wherein said trip lever includes a first end which overlays said actuating element of said trip actuator, and a second end of said trip lever being coupled to said trip bar; and wherein the first end of said trip lever is cooperable with the first end of said reset lever of said trip actuator reset assembly.

* * * * *